US006860098B2

(12) United States Patent
Suenaga et al.

(10) Patent No.: US 6,860,098 B2
(45) Date of Patent: Mar. 1, 2005

(54) GAS TURBINE COMBUSTOR HAVING BYPASS AND ANNULAR GAS PASSAGE FOR REDUCING UNEVEN TEMPERATURE DISTRIBUTION IN COMBUSTOR TAIL CROSS SECTION

(75) Inventors: Kiyoshi Suenaga, Takasago (JP); Shigemi Mandai, Takasago (JP); Katsunori Tanaka, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 38 days.

(21) Appl. No.: 10/098,146

(22) Filed: Mar. 15, 2002

(65) Prior Publication Data

US 2002/0152740 A1 Oct. 24, 2002

(30) Foreign Application Priority Data

Apr. 24, 2001 (JP) ..... 2001-126593

(51) Int. Cl.[7] ..... F02C 9/00

(52) U.S. Cl. ..... 60/39.23; 60/752

(58) Field of Search ..... 60/39.23, 39.29, 60/752, 796, 769, 39.27, 39.53, 776, 782, 785, 795, 799; 431/1, 2, 4, 10, 12, 350, 351, 352, 353

(56) References Cited

U.S. PATENT DOCUMENTS

| | | | | | |
|---|---|---|---|---|---|
| 2,575,070 | A | * | 11/1951 | Reed et al. | 60/736 |
| 2,684,573 | A | * | 7/1954 | Marskell et al. | 60/39.23 |
| 2,692,478 | A | * | 10/1954 | Hill | 60/752 |
| 3,705,492 | A | | 12/1972 | Vickers | |
| 4,427,362 | A | * | 1/1984 | Dykema | 431/4 |
| 4,519,769 | A | * | 5/1985 | Tanaka | 431/4 |
| 5,285,630 | A | * | 2/1994 | Ansart et al. | 60/39.23 |
| 5,351,474 | A | * | 10/1994 | Slocum et al. | 60/39.23 |
| 5,548,951 | A | * | 8/1996 | Mumford et al. | 60/39.23 |
| 5,735,126 | A | | 4/1998 | Schulte-Werning | |
| 5,950,417 | A | * | 9/1999 | Robertson et al. | 60/776 |
| 6,327,845 | B2 | * | 12/2001 | Ojiro et al. | 60/39.23 |
| 6,449,956 | B1 | * | 9/2002 | Kolman et al. | 60/777 |
| 6,553,766 | B2 | * | 4/2003 | Shimizu et al. | 60/752 |
| 2001/0004515 | A1 | * | 6/2001 | Scarinci et al. | 431/352 |

FOREIGN PATENT DOCUMENTS

| | | | |
|---|---|---|---|
| GB | 2034874 | * | 6/1980 |
| JP | 363150432 A | * | 6/1988 |
| JP | 7-113329 | | 12/1995 |
| JP | 8-261018 | | 10/1996 |

* cited by examiner

*Primary Examiner*—Charles G. Freay
(74) *Attorney, Agent, or Firm*—Oblon, Spivak, McClelland, Maier & Neustadt, P.C.

(57) ABSTRACT

There is provided a combustor to burn fuel, comprising a bypass passage connected to one side of the combustor to supply air into the combustor; and an annular passage provided around the combustor and connected to the bypass passage, wherein air supplied through the bypass passage passes in the annular passage in the circumferential direction, and is uniformly supplied into the combustor in the circumferential direction thereof through an opening which connects the combustor and the annular passage. Accordingly, compressed air passing through the bypass passage can be supplied uniformly into a tail portion of the combustor, and unevenness of temperature distribution in a cross section of the combustor tail portion can be reduced.

6 Claims, 10 Drawing Sheets

GAS TURBINE COMBUSTOR HAVING BYPASS AND ANNULAR GAS PASSAGE FOR REDUCING UNEVEN TEMPERATURE DISTRIBUTION IN COMBUSTOR TAIL CROSS SECTION

BACKGROUND OF THE INVENTION

1. Field of the Invention

The present invention relates to a combustor, particularly to a gas turbine combustor in which additional air can be supplied by a bypass passage.

2. Description of the Related Art

In general, a gas turbine combustor is disposed between a compressor and a turbine. Fuel F is supplied to a gas turbine combustor through a fuel supplying passage of a nozzle portion in the gas turbine combustor. Compressed air A compressed by the compressor is supplied to a casing of the gas turbine combustor and, then enters the nozzle portion through an inlet portion of the nozzle portion and is supplied to the combustor through a swirler. Thus, the compressed air A and the fuel F are mixed and burned in the combustor. High temperature gas produced by combustion of the compressed air A and the fuel F is discharged from the combustor through a tail portion thereof to drive the turbine provided on the downstream side of the gas turbine combustor in the direction of air flow.

A bypass passage having a bypass valve is provided on one side of the combustor tail portion. When the output of the turbine varies, the bypass valve is opened and closed so that the compressed air A in the casing is supplied to the combustor tail portion through the bypass passage from the inlet portion to an outlet portion thereof. Accordingly, additional compressed air A is supplied to the combustor tail portion so that the air-fuel ratio, i.e., the ratio of air to fuel in the gas turbine combustor can be maintained at an appropriate value.

However, the bypass passage is attached to only one side of the combustor in a known gas turbine combustor. Therefore, when additional compressed air A is supplied to the combustor tail portion through the bypass passage, the concentration of fuel in the combustor tail portion is locally decreased in the vicinity of the outlet of the bypass passage.

In general, when the ratio of combustion air to fuel is high, the flame becomes unstable due to lack of fuel. In addition, when the ratio of fuel to combustion air is high, NOx tends to easily occur. In other words, the flame tends to become unstable in the vicinity of the outlet of the bypass passage, and NOx tends to occur at the opposite side of the outlet, in a cross section of the combustor tail portion. Therefore, if the bypass valve is adjusted to maintain the air-fuel ratio at a substantially constant value, it is necessary for the additional compressed air passing through the bypass passage to be uniformly supplied to the combustor tail portion in the circumferential direction thereof.

The additional compressed air A is supplied to the combustor, particularly to the combustor tail portion via the outlet of the bypass passage, so that the temperature in the vicinity of the outlet is locally decreased, and unevenness of the temperature distribution occurs in a cross section of the combustor tail portion.

Accordingly, the object of the present invention is to provide a combustor in which the compressed air passing through the bypass passage is uniformly supplied into the combustor tail portion in the circumferential direction thereof, and unevenness of the temperature distribution in a cross section of the combustor tail portion is reduced.

SUMMARY OF THE INVENTION

According to an embodiment of the present invention, the present invention provides a combustor to burn fuel, comprising a bypass passage connected to one side of the combustor to supply air into the combustor; and an annular passage provided around the combustor and connected to the bypass passage, wherein air supplied through the bypass passage passes through the annular passage in the circumferential direction, and is uniformly supplied into the combustor in the circumferential direction thereof through an opening which connects the combustor and the annular passage.

Namely, according to the embodiment of the present invention, air passing through the bypass passage is uniformly supplied in the circumferential direction of the combustor and particularly to the combustor tail portion to thereby reduce unevenness of the temperature distribution in a cross section of the combustor tail portion.

These and other objects, features and advantages of the present invention will be more apparent in light of the detailed description of exemplary embodiments thereof as illustrated by the drawings.

BRIEF DESCRIPTION OF THE DRAWING

The present invention will be more clearly understood from the description as set below with reference to the accompanying drawings, wherein.

DESCRIPTION OF THE PREFERRED EMBODIMENTS

Before proceeding to a detailed description of the preferred embodiments, a prior art will be described with reference to the accompanying drawings relating thereto for a clearer understanding of the difference between the prior art and the present invention.

Figure 1:
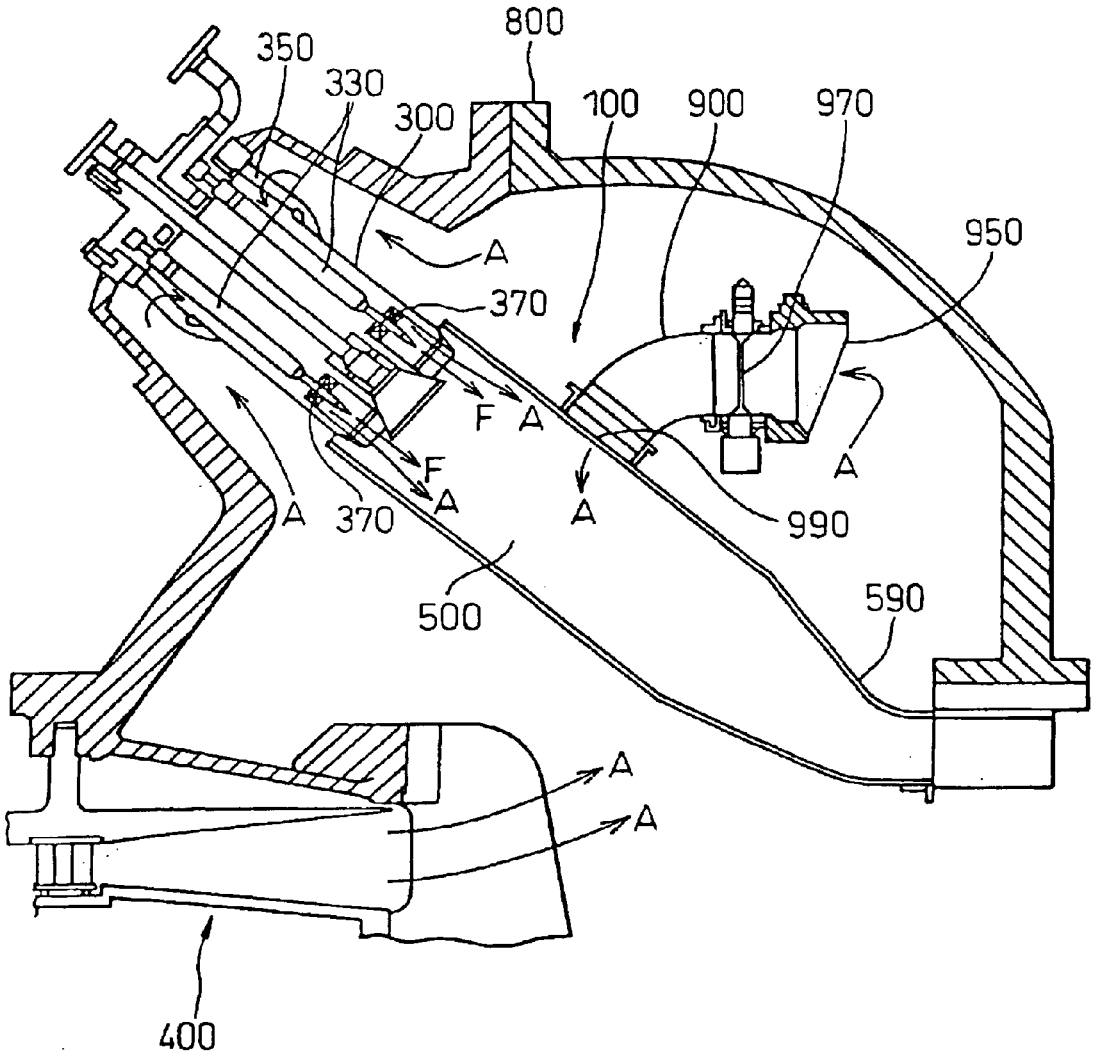
PRIOR ART Fig.1
FIG. 1 is a sectional view of a known gas turbine combustor.

FIG. 1 is a cross sectional view of a gas turbine combustor disclosed in a related art, for example, Japanese Unexamined Patent Publication (Kokai) No. 2000-130756. Such gas turbine combustor is disposed between a compressor and a turbine. Fuel F is supplied to a gas turbine combustor 100 through a fuel supplying passage 330 of a nozzle portion 300 in the gas turbine combustor 100. Compressed air A compressed by a compressor 400 is supplied into a casing 800 of the gas turbine combustor 100. The compressed air A enters the nozzle portion 300 through an inlet portion 350 of the nozzle portion 300 and is supplied into the combustor through a swirler 370. Therefore, the compressed air A and the fuel F are mixed and burned in the combustor. High temperature gas produced by combustion of the compressed air A and the fuel F is discharged from the combustor through a tail portion thereof to drive a turbine (not shown) provided on the downstream side of the gas turbine combustor 100 in the direction of air flow.

A bypass passage 900 having a bypass valve 970 is provided on one side of the combustor tail portion 500. When the output of the turbine varies, the bypass valve 970 is opened and closed so that the compressed air A in the casing 800 is supplied to the combustor tail portion 500 through the bypass passage 900 from an inlet portion 950 to an outlet portion 990 thereof. Accordingly, the additional compressed air A is supplied to the combustor tail portion 500 so that the air-fuel ratio, i.e., the ratio of air to fuel in the gas turbine combustor 100 can be maintained at an appropriate value.

An embodiment of the present invention will be described below with reference to accompanying drawings. In following drawings, the same members are designated by similar numerals.

Figure 2:
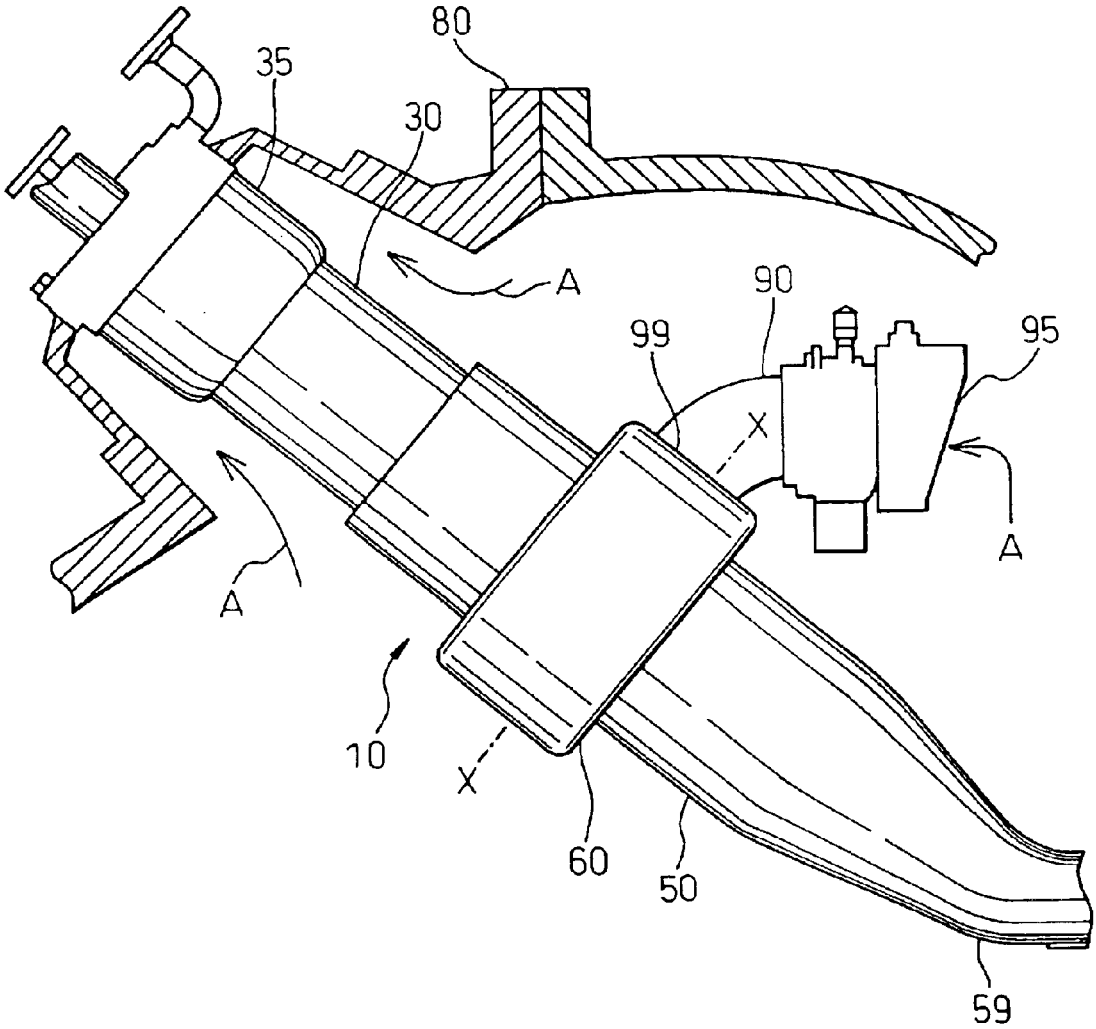
FIG. 2 is a side view of a combustor according to a first embodiment of the present invention.
Figure 4:
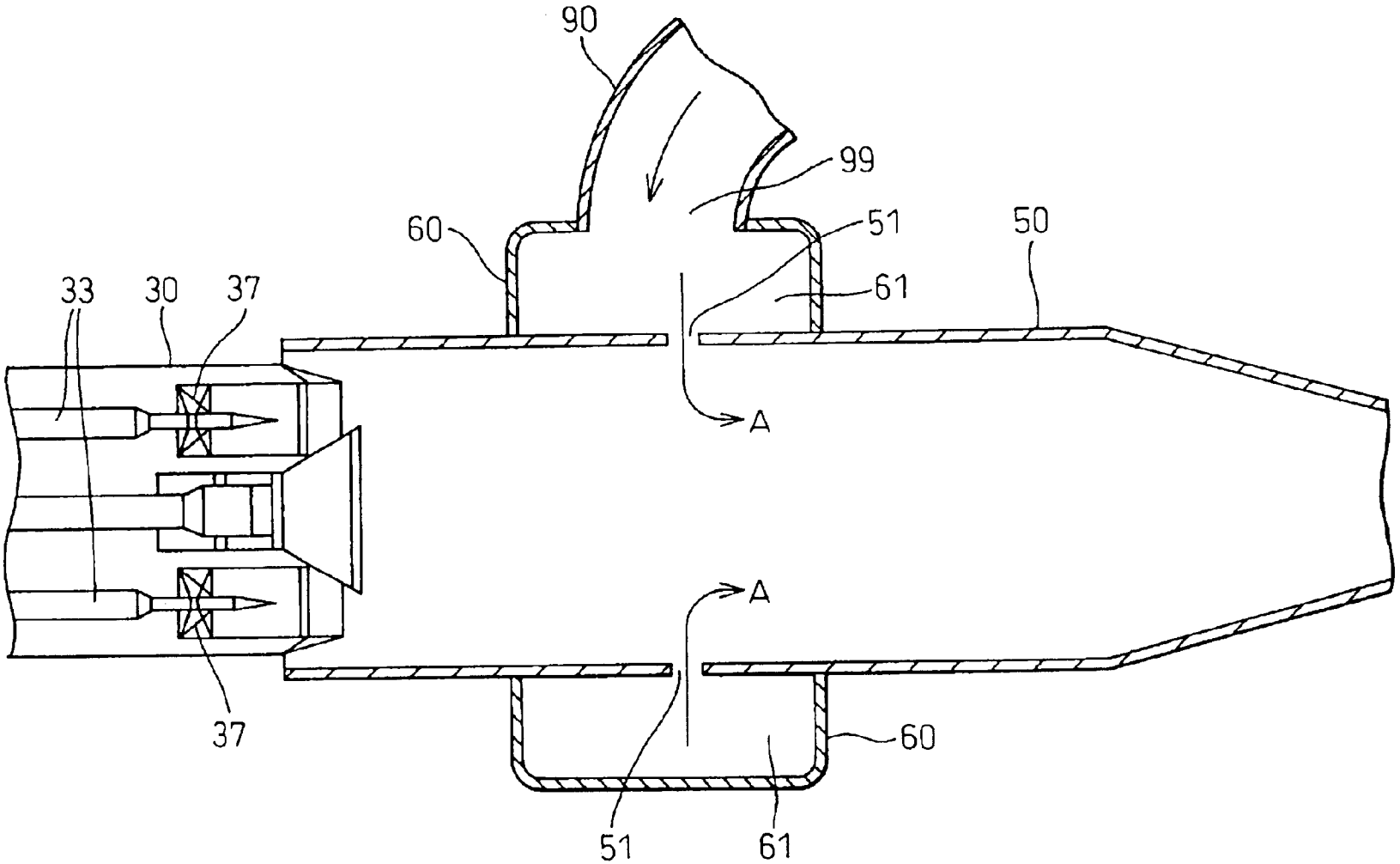
FIG. 4 is a longitudinal partial sectional view of a combustor according to a first embodiment of the present invention.

FIG. 2 and FIG. 4 show a side view and a longitudinal partial sectional view of a combustor according to a first embodiment of the present invention, respectively. As shown in FIG. 4, the fuel F is supplied to the gas turbine combustor 10 through a fuel supplying passage 33 provided in a nozzle 30. The compressed air A compressed by a compressor (not shown) enters the nozzle 30 through the inlet portion 35 and is supplied into the gas turbine combustor 10 through a swirler 37. The fuel F and the compressed air A are mixed and burned in the combustor.

Figure 3:
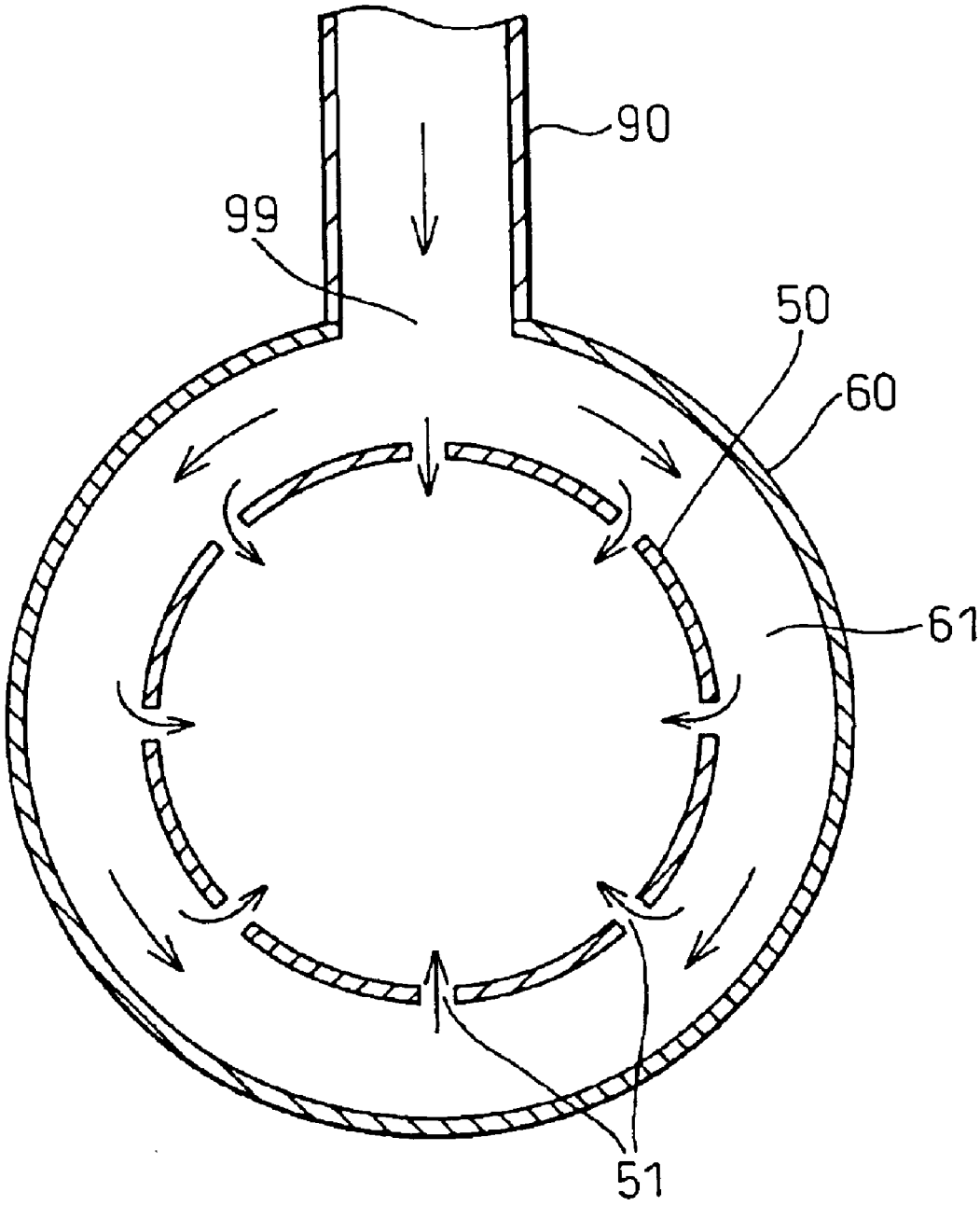
FIG. 3 is a sectional view taken along the line X—X in FIG. 2.

A bypass passage 90 is connected to one side of a combustor tail portion 50. The bypass passage 90 contains a bypass valve 97 (not shown). As shown in FIG. 2, in the first embodiment, an annular passage containing member which contains an annular passage therein, i.e., an annular scroll 60, is disposed between the combustor tail portion 50 and the bypass passage 90. As shown in FIG. 3 which is a cross sectional view taken along the line X—X in FIG. 2, an annular passage 61 extending in the circumferential direction is formed in the annular scroll 60. The annular scroll 60 is provided on the outer peripheral portion of the combustor tail portion 50 substantially coaxially to the center axis of the combustor. As shown in FIG. 3 and FIG. 4, a plurality of openings 51 are formed in a wall portion of the combustor tail portion 50. In the first embodiment, the openings 51 formed in the wall portion of the combustor tail portion 50 are spaced at a substantially equal distance in the circumferential direction. Therefore, the bypass passage 90 and the annular scroll 60 are connected to each other via the outlet 99, and the annular scroll 60 and the combustor tail portion 50 are connected to each other via the openings 51.

When the output of a turbine (not shown) varies and a partial load is applied to the gas turbine combustor 10, the bypass valve 97 is opened. Accordingly, additional compressed air A can be supplied from a casing 80 into the bypass passage 90 through the inlet portion 95 of the bypass passage 90. As shown in FIG. 3, the additional compressed air A enters the annular scroll 60 through the outlet portion 99 of the bypass passage 90. The additional compressed air A enters the combustor tail portion 50 through the annular passage 61 of the annular scroll 60 and openings 51 formed in the wall portion of the combustor tail portion 50. Therefore, the additional compressed air A is supplied substantially uniformly to the combustor, particularly to the combustor tail portion 50, in the circumferential direction thereof. Accordingly, unevenness of the temperature distribution in the cross section of the combustor can be reduced when the partial load is applied. Slits can be formed on the wall portion of the combustor tail portion 50 in the circumferential direction thereof, in place of the openings 51. In this case, the additional compressed air A can be more uniformly supplied into the combustor tail portion 50.

Figure 5:
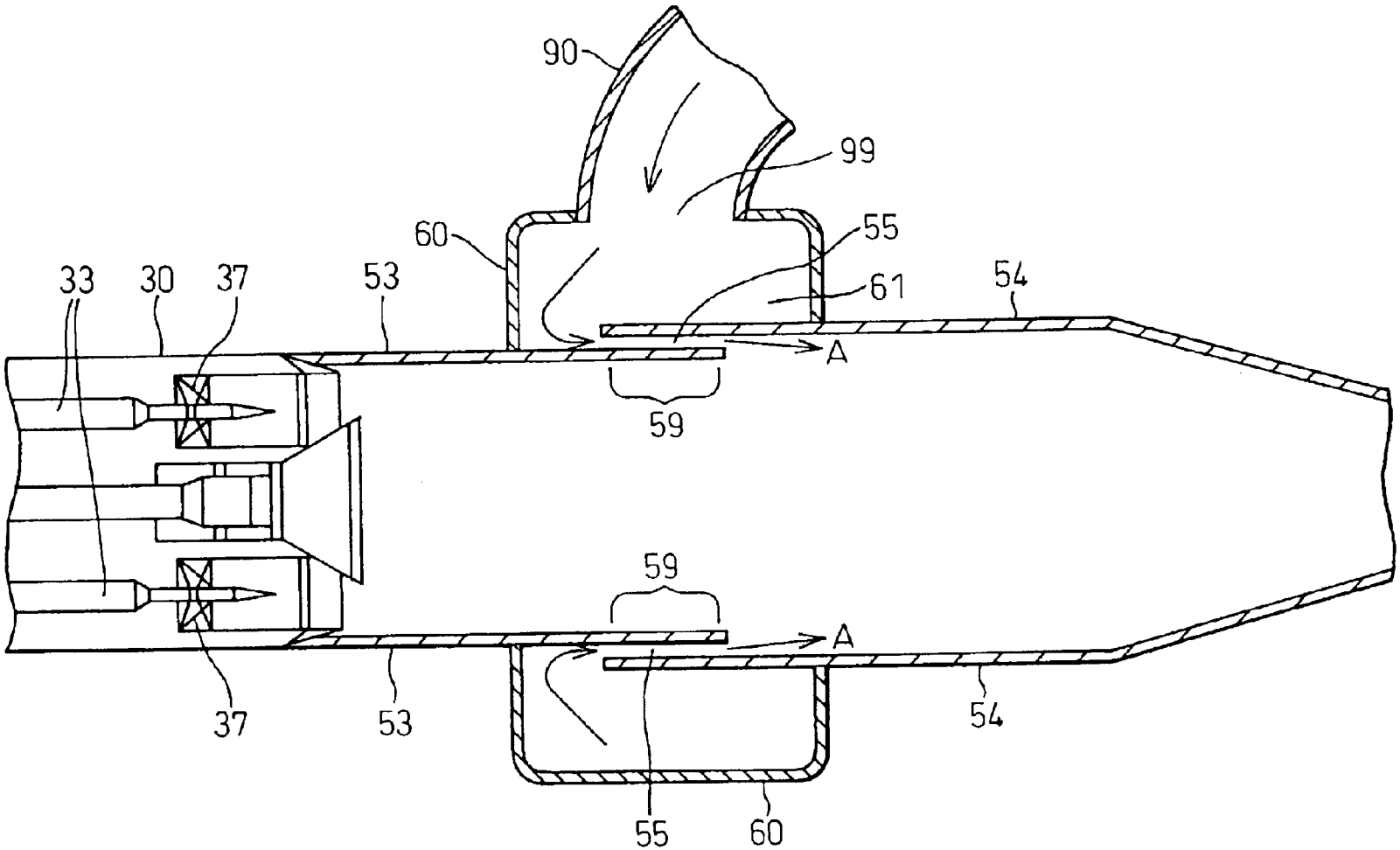
FIG. 5 is a longitudinal partial sectional view of a combustor according to a second embodiment of the present invention.

FIG. 5 is a longitudinal partial sectional view of a combustor according to a second embodiment of the present invention. In the second embodiment, the combustor contains a first cylinder portion 53 and a second cylinder portion 54. As shown in FIG. 5, the first cylinder portion 53 and the second cylinder portion 54 are coaxially arranged and are partly overlapped with a predetermined space therebetween, so that an annular or cylindrical clearance 55 is formed between these cylinder portions. It is apparent from FIG. 5 that a superimposed portion 59, in which these cylinder portions are overlapped, i.e., superimposed, is positioned in the annular scroll 60. An upstream side end portion of the annular scroll 60 positioned on the upstream side in the flow direction of fuel F in the annular scroll 60 and a downstream side end portion of the annular scroll positioned on the downstream side are connected to the first cylinder portion 53 and the second cylinder portion 54, respectively. Therefore, the additional compressed air A in the annular scroll 60 does not leak out.

Additional compressed air A entering from the bypass passage 90 into the annular scroll 60 passes along the inner wall of the combustor tail portion 50 via the annular passage 61 and the annular space 55. Accordingly, a thin layer of a low-temperature airflow (a so-called cooling film) is formed along the inner wall of the combustor tail portion 50, and then the combustor tail portion 50 is cooled by the low-temperature airflow layer (such a cooling method is called "film cooling"). An annular cooling film is formed because the space 55 is annular, and thus the combustor tail portion 50 can be uniformly cooled in the circumferential direction thereof. In other words, according to the second embodiment, additional compressed air passing through the bypass passage can be uniformly supplied to the combustor, particularly to the combustor tail portion in the circumferential direction thereof, and unevenness of the temperature distribution in a cross section of the combustor tail portion can be reduced.

Figure 6A:
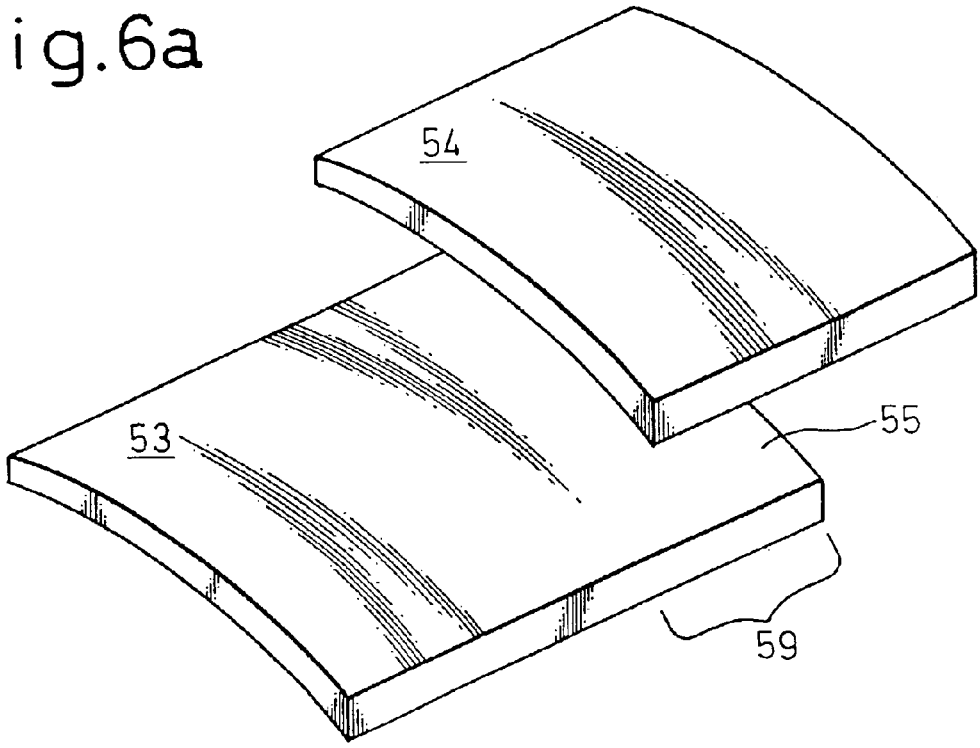
FIG. 6*a* is an enlarged schematic view of an overlapped portion of a first cylinder portion and a second cylinder portion in FIG. 5.
Figure 6B:
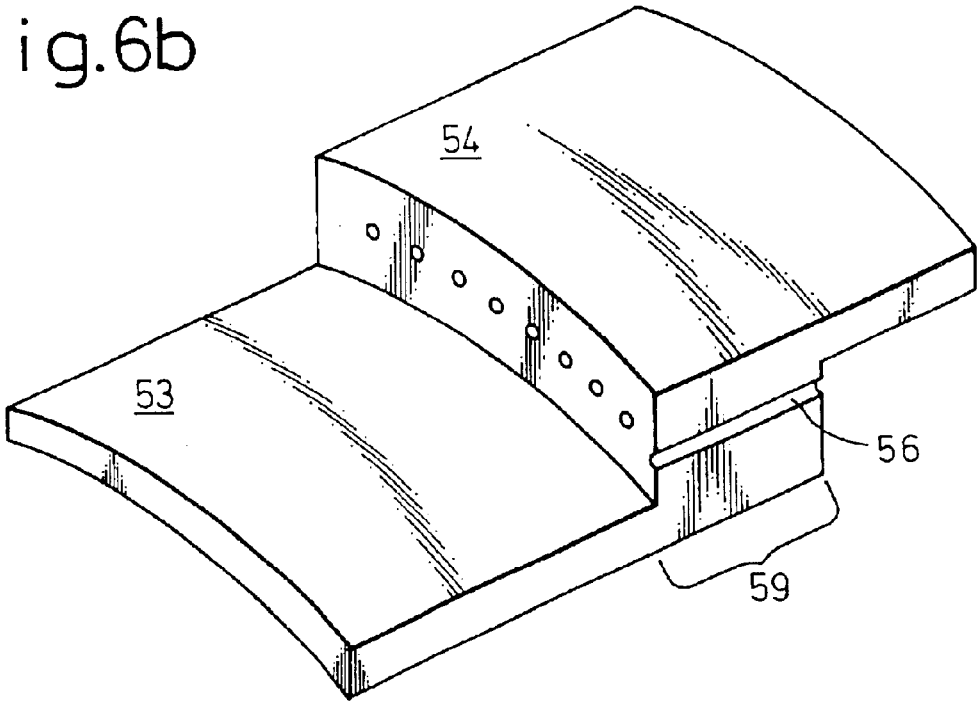
FIG. 6*b* is an enlarged schematic view of an overlapped portion of a first cylinder portion and a second cylinder portion in FIG. 5.

FIG. 6*a* and FIG. 6*b* are schematic views of the superimposed portion 59 of the first cylinder portion 53 and the second cylinder portion 54. In the second embodiment, as shown in FIG. 6*a*, the first cylinder portion 53 and the second cylinder portion 54 are separate members, and define the annular space 55. However, as shown in FIG. 6*b*, the first cylinder portion 53 and the second cylinder portion 54 may be integrally formed as a single member, and a plurality of through holes 56 extending in the axial direction of the combustor tail portion 50 may be formed in the superimposed portion 59. The through holes 56 are spaced at an equal distance in the circumferential direction. In this case, since the cooling film extends to a portion further downstream to that of the embodiment shown in FIG. 6*a*, the combustor tail portion 50 can be cooled over a wider area.

Figure 7:
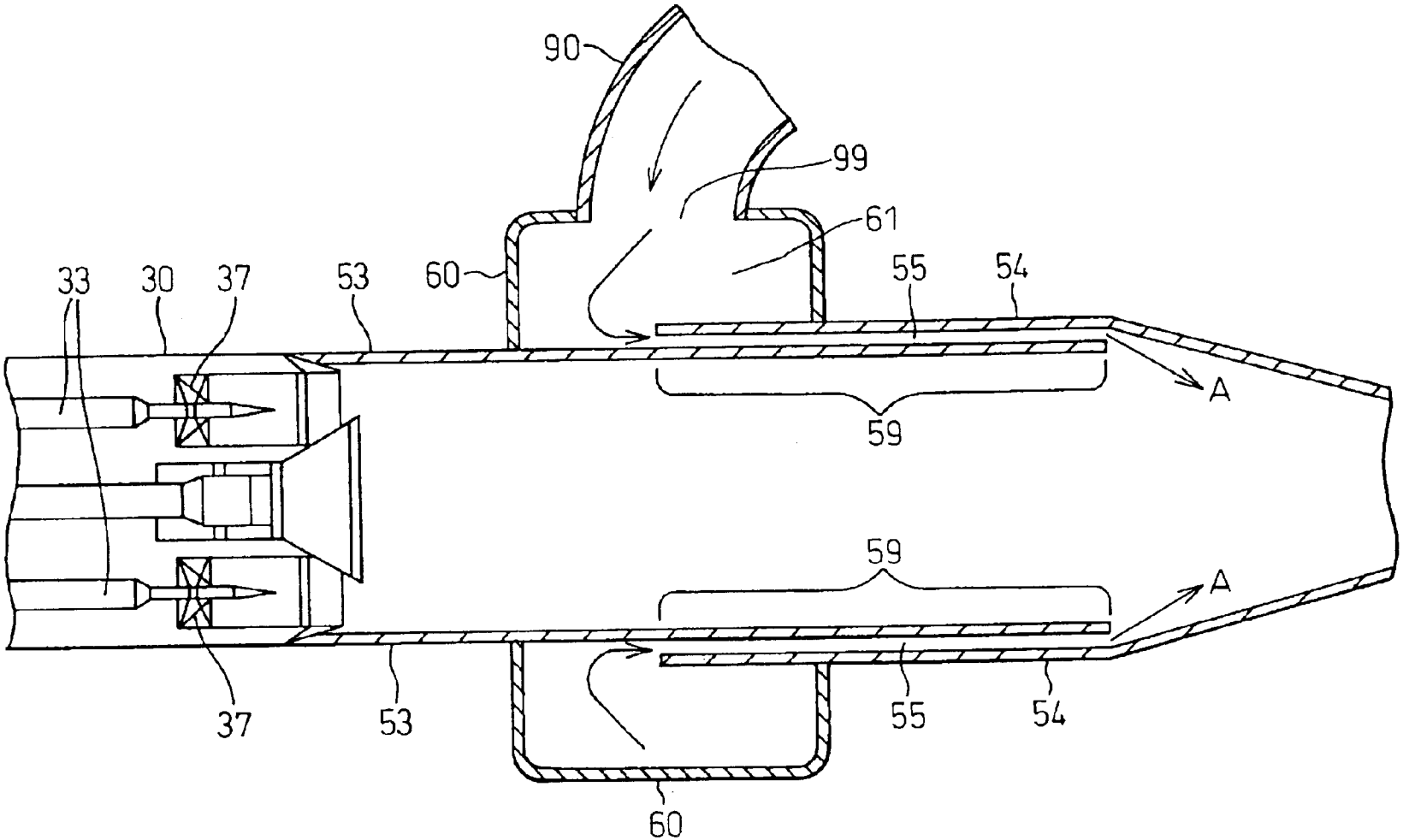
FIG. 7 is a longitudinal partial sectional view of a combustor according to a third embodiment of the present invention.

FIG. 7 is a longitudinal partial sectional view of a third embodiment of a combustor according to the present invention. The combustor contains the first cylinder portion 53 and the second cylinder portion 54. In the third embodiment, the superimposed portion 59 in which the first cylinder portion 53 and the second cylinder portion 54 are partially superimposed extends beyond the annular scroll 60 on the downstream side, in the flow direction of fluid, in the combustor. Additional compressed air A entering from the bypass passage 90 into the annular passage 61 of the annular scroll 60 enters the annular space 55 of the superimposed portion 59. The additional compressed air A passes through the annular space 55 to thereby effectively cool the combustor, particularly the combustor tail portion 50, by convection cooling. The combustor tail portion 50 can be cooled substantially uniformly in the circumferential direction over a wide area by convection cooling. In other words, according to the third embodiment, air passing through the bypass passage can be uniformly supplied in the circumferential direction of the combustor tail portion, and unevenness of the temperature distribution in the cross section of the combustor tail portion can be reduced over a wide area.

As a matter of course, as shown in FIG. 6*b*, the first and second cylinder portions 53, 54 are formed as a single member, and a plurality of through holes 56 may be formed in the superimposed portion 59 in place of the annular space 55. In the above-described second embodiment, it is apparent that convection cooling is partially carried out in the superimposed portion 59.

Figure 8:
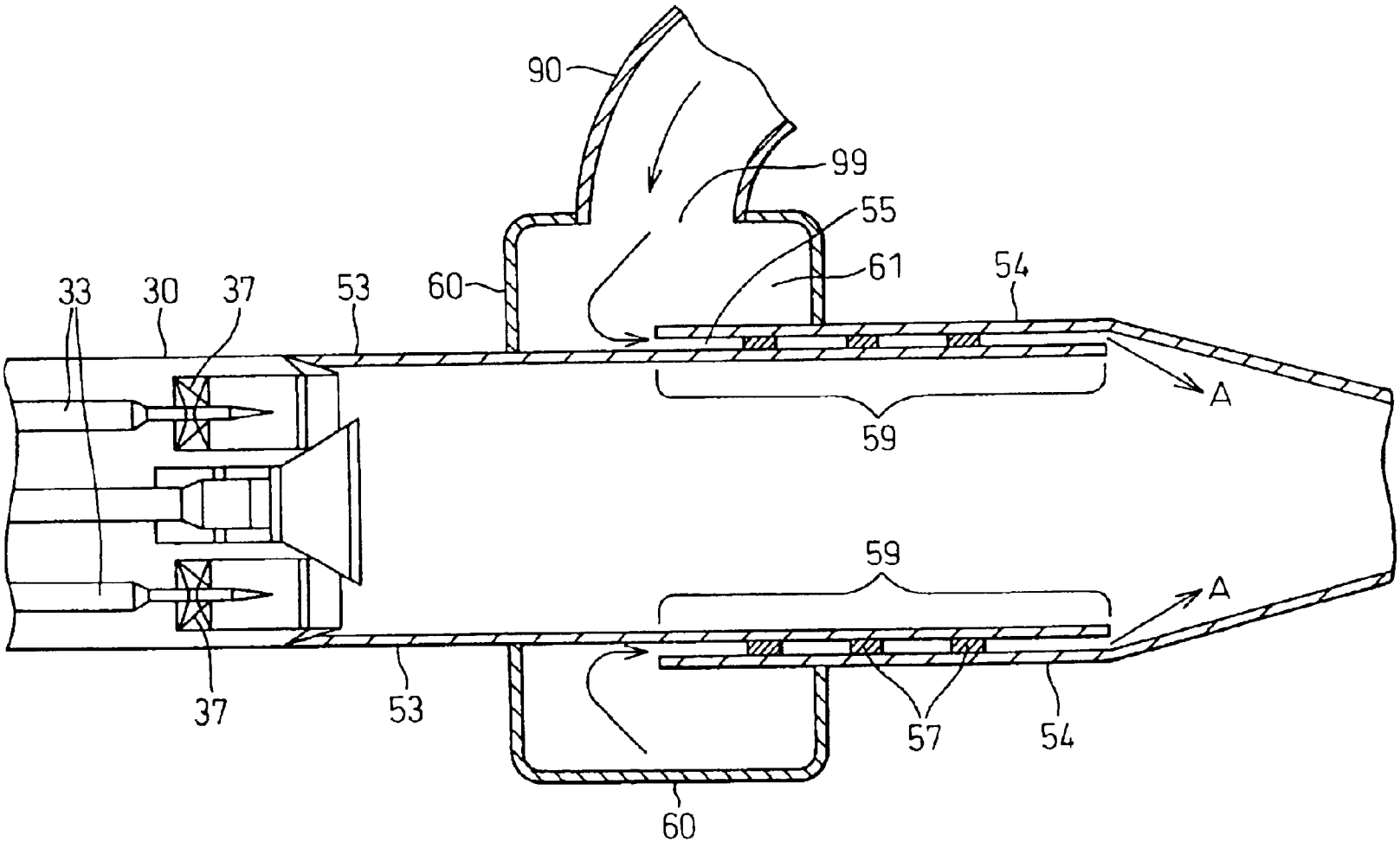
FIG. 8 is a longitudinal partial sectional view of a combustor according to another embodiment.
Figure 9A:
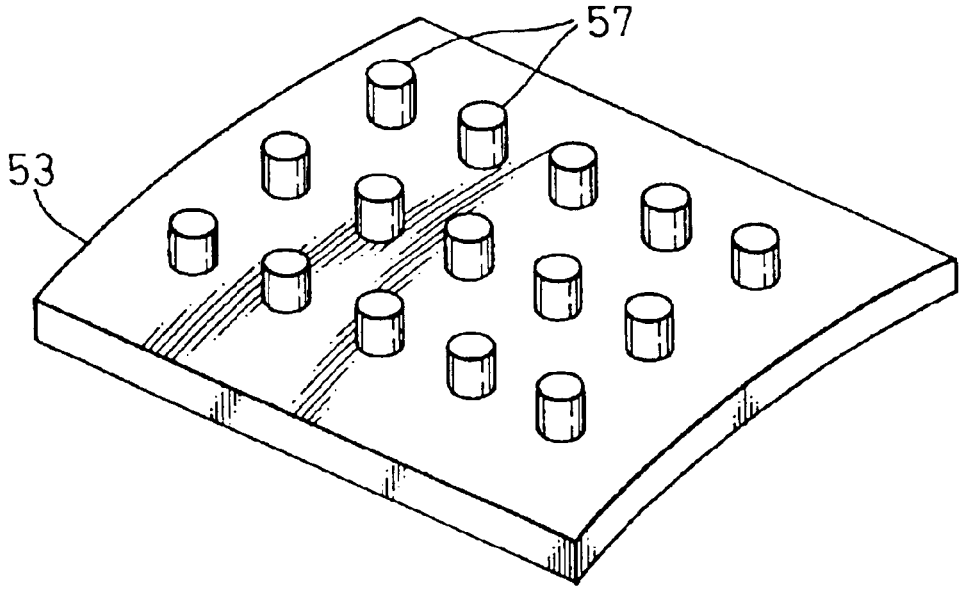
FIG. 9*a* is an enlarged schematic view of a supporting member in FIG. 8.
Figure 9B:
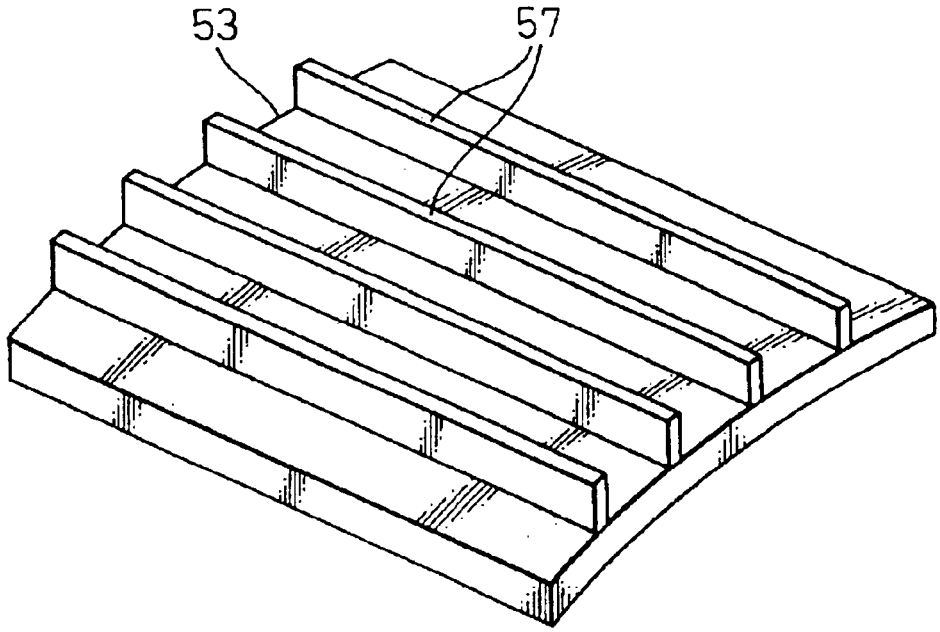
FIG. 9*b* is an enlarged schematic view of a supporting member in FIG. 8.

FIG. 8 is a longitudinal partial sectional view of another embodiment of a combustor according to the present invention. The combustor contains the first cylinder portion 53 and the second cylinder portion 54. Similar to the above-described third embodiment, the annular space 55 is formed in the superimposed portion 59 in which the first cylinder portion 53 and the second cylinder portion 54 are partially superimposed. In this embodiment, a plurality of supporting members 57 are disposed between the first cylinder portion 53 and the second cylinder portion 54 and in the superimposed portion 59. FIG. 9*a* and FIG. 9*b* are partially enlarged views of the first cylinder portion 53 having the supporting member 57. In FIG. 9*a*, a plurality of columnar supporting members 57 are spaced at an equal distance with each other on the outer wall of the first cylinder portion 53. The inner wall of the second cylinder portion 54 is disposed on the top face of the supporting member 57. However, for ease of understanding, the second cylinder portion 54 is omitted in FIG. 9*a* and FIG. 9*b*. The first cylinder portion 53 and the second cylinder portion 54 can be supported by the supporting members 57, against combustion vibration caused during the operation of the combustor. Therefore, the annular space 55 can be maintained without being crushed by combustion vibration. Furthermore, the supporting member 57 can improve heat transferring between the first cylinder portion 53 and the second cylinder portion 54. Thus, according to the embodiment, air passing through the bypass passage is uniformly supplied to the combustor, particularly to the combustor tail portion in the circumferential direction thereof, so that the unevenness of the temperature distribution in the cross section of the combustor tail portion can be reduced. As a matter of course, in the above-described second embodiment, the arrangement of the supporting member in the annular space 55 is included within the scope of protection of the present invention.

Figure 10:
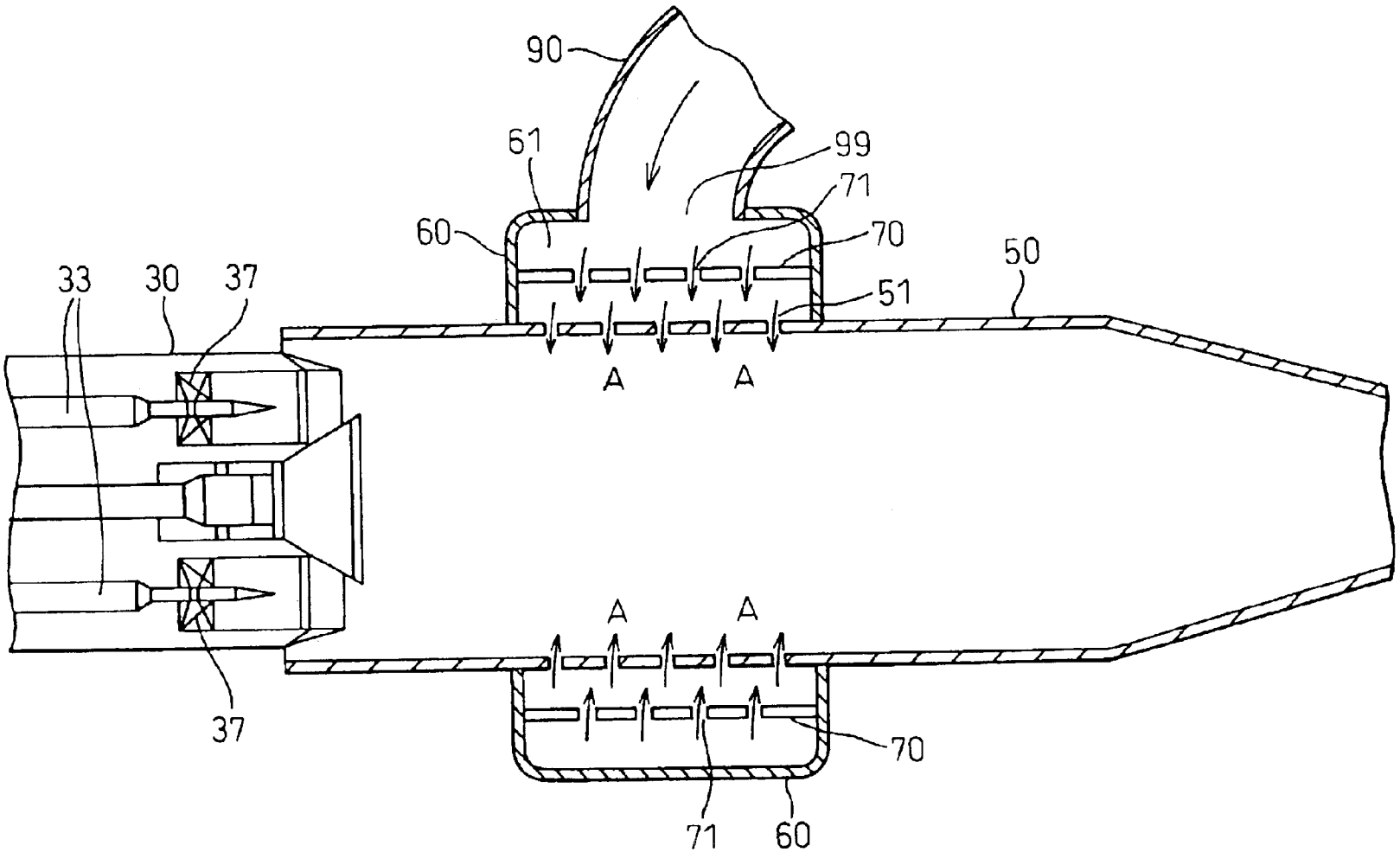
FIG. 10 is a longitudinal partial sectional view of a combustor according to a forth embodiment of the present invention.

FIG. 10 is a longitudinal partial sectional view of a forth embodiment of a combustor according to the present invention. In the forth embodiment, a sleeve 70 is arranged substantially coaxially to the center axis of the combustor tail portion 50, between the outer wall of the combustor tail portion 50 and the inner wall of the annular scroll 60. Therefore, the sleeve 70 and the outer wall of combustor tail portion 50 are substantially parallel. The length in the axial direction of the sleeve 70 is substantially identical to that of the annular scroll 60. As shown in FIG. 10, a plurality of holes 71 are formed in the sleeve 70. A plurality of openings 51 are formed in the combustor tail portion 50 within the annular scroll 60. In the forth embodiment, the plural openings 51 and the plural holes 71 are disposed in a staggered configuration.

The additional compressed air A entering the annular scroll 60 through the bypass passage 90 passes through the annular passage 61 and the hole 71 of the sleeve 70 and impinges on the outer wall of the combustor tail portion 50. The sleeve 70 and the combustor tail portion 50 are coaxial to each other, so that the additional compressed air A passing through the hole 71 of the sleeve 70 impinges substantially vertically on the outer wall of the combustor tail portion 50. A cooling method in which fluid is vertically supplied onto the surface of the object to be cooled is called "impinge cooling" or "impingement cooling". Then, the additional compressed air A enters the combustor tail portion 50 through the opening 51 of the combustor tail portion 50.

In the forth embodiment, the additional compressed air passing through the bypass passage 90 is uniformly supplied to the combustor, particularly to the combustor tail portion in the circumferential direction thereof, so that unevenness of the temperature distribution in the cross section of the combustor tail portion can be reduced by impinge cooling. It is preferable that the opening 51 not be formed at a position of the combustor tail portion 50 corresponding to the hole 71, since this improves the effect of impinge cooling. The sleeve 70 functions as an acoustic liner so that combustion vibration produced when the combustor is operated can be decreased.

As a matter of course, any combination of the embodiments described above to produce the combustor is included within the scope of the present invention. For example, to form an annular passage on the wall portion of the combustor without the annular scroll is within the scope of the present invention.

According to an embodiment of the present invention, the common effect can be obtained that the additional air passing through the bypass passage is supplied to the combustor, particularly to the combustor tail portion uniformly in the circumferential direction thereof, so that unevenness of the temperature distribution in a cross section of the combustor tail portion can be reduced.

According to another embodiment of the present invention, the effect can be obtained that the additional air can be further uniformly supplied from the bypass passage to the combustor, particularly to the combustor tail portion.

According to yet another embodiment of the present invention, the effect can be obtained that the combustor, particularly, the combustor tail portion, can be effectively cooled by a cooling film.

According to yet another embodiment of the present invention, the effect can be obtained that the combustor, particularly, the combustor tail portion, can be effectively cooled by convection cooling.

According to yet another embodiment of the present invention, the effect can be obtained that the supporting member is provided between the first cylinder portion and the second cylinder portion to support the same, and what can improve the heat transferring.

According to yet another embodiment of the present invention, the effect can be obtained that the combustor, particularly, the combustor tail portion, can be effectively cooled by impinge cooling, and the sleeve functions as an acoustic liner to reduce combustion vibration.

Although the invention has been shown and described with exemplary embodiments thereof, it should be understood by those skilled in the art that the foregoing and various other changes, omissions and additions may be made therein and thereto without departing from the spirit and scope of the invention.

What is claimed is:

1. A combustor to bum fuel, comprising:

a bypass passage configured to completely bypass an inlet portion of the combustor, said bypass passage having a valve, and connected to one side of the combustor to supply air into the combustor; and an annular passage provided around the combustor and connected to the bypass passage, wherein air supplied through the bypass passage passes in the annular passage in a circumferential direction, and is substantially uniformly supplied circumferentially into the combustor through at least one axially extending through hole that connects the combustor and the annular passage.

2. A combustor to burn fuel, comprising:

a bypass passage bypassing an inlet portion of the combustor, said bypass passage having a valve, and connected to one side of the combustor to supply air into the combustor; and an annular passage provided around the combustor and connected to the bypass passage, wherein air supplied through the bypass passage passes in the annular passage in a circumferential direction, and is substantially uniformly supplied circuinferentially into the combustor in an axial direction through at least one opening which connects the combustor and the annular passage, and the combustor comprises a first cylinder portion and a second cylinder portion, these cylinder portions partially overlap with a predetermined space therebetween, inside the combustor, and the non-overlapping cylinder portions encompassed by the annular passage form a separating wall between the combustor and the annular passage, the opening is defined by an annular space formed between the first cylinder portion and the second cylinder portion, and air supplied from the bypass passage to the annular passage is supplied into the combustor through the annular space.

3. A combustor according to claim 2, wherein at least one supporting member to support the first cylinder portion and the second cylinder portion is provided in the annular space.

4. A combustor to burn fuel, comprising:

a bypass passage bypassing an inlet portion of the combustor, said bypass passage having a valve, and connected to one side of the combustor to supply air into the combustor; and an annular passage provided around the combustor and connected to the bypass passage, wherein air supplied through the bypass passage passes in the annular passage in a circumferential direction, and is substantially uniformly supplied circumferentially into the combustor in an axial direction through at least one opening which connects the combustor and the annular passage, and the combustor comprises a first cylinder portion and a second cylinder portion, these cylinder portions partially overlap with a predetermined space, outside the annular passage, the opening is defined by an annular space formed between the first cylinder portion and the second cylinder portion, and air supplied from the bypass passage to the annular passage is supplied into the combustor through the annular space.

5. A combustor according to claim 4, wherein at least one supporting member to support the first cylinder portion and the second cylinder portion is provided in the annular space.

6. A combustor to bum fuel, comprising:

a bypass passage bypassing an inlet portion of the combustor, said bypass passage having a valve, and connected to one side of the combustor to supply air into the combustor; and an annular passage provided around the combustor and connected to the bypass passage, wherein air supplied through the bypass passage passes in the annular passage in a circumferential direction, and is substantially uniformly supplied circumferentially into the combustor in an axial direction through at least one opening which connects the combustor and the annular passage, and the combustor comprises a sleeve in which a plurality of holes are formed, provided substantially coaxially to the center axis of the combustor between the outer wall of the combustor and the inner wall of the annular passage, at least a part of the plural holes is formed at a position corresponding to the outer wall of the combustor, and at least a part of air supplied through the bypass passage is supplied to impinge on the outer wall of the combustor, through the holes of the sleeve, whereby the air is supplied to the combustor through the opening.

* * * * *